United States Patent [19]

Macor

[11] Patent Number: 4,840,094

[45] Date of Patent: Jun. 20, 1989

[54] MULTIPLE SOCKET AND MULTIPLE SOCKET WRENCH

[76] Inventor: Richard J. Macor, 13H Franklin Greens, Somerset, N.J. 08873

[21] Appl. No.: 680,321

[22] Filed: Dec. 10, 1984

Related U.S. Application Data

[63] Continuation-in-part of Ser. No. 468,779, Feb. 22, 1983, abandoned.

[51] Int. Cl.[4] ..... B25B 13/58

[52] U.S. Cl. ..... 81/185; 81/124.5; 81/124.6; 81/177.85

[58] Field of Search ..... 81/185, DIG. 11, 124.3, 81/124.4, 124.5, 124.6, 124.7, 177.85

[56] References Cited

U.S. PATENT DOCUMENTS

| | | | |
|---|---|---|---|
| 2,322,856 | 6/1943 | LeRoue | 81/185 |
| 2,571,570 | 10/1951 | Hagar | 81/185 |
| 2,803,158 | 8/1957 | King | 87/185 X |
| 2,814,227 | 11/1957 | Cushman | 81/185 |
| 3,187,610 | 6/1965 | Russman | 81/185 |

*Primary Examiner*—James G. Smith

*Attorney, Agent, or Firm*—Kenneth P. Glynn

[57] ABSTRACT

The present invention is a multiple socket device and a wrench employing same wherein the socket device has four different socket sizes located about a single axis comprising a first (outer) member and a second (inner) member. Both members are hollow and the second slidably fits into the first. Each member has an upper portion and a lower portion, and each such portion has a different inside diameter corresponding to one of the four different socket sizes. The outer surface of the inner member, as well as the inner surface of both the inner member and the outer member, are entirely arrayed with angular longitudinal grooves.

30 Claims, 3 Drawing Sheets

MULTIPLE SOCKET AND MULTIPLE SOCKET WRENCH

REFERENCE TO RELATED CASE

This application is a continuation-in-part of copending U.S. patent application Ser. No. 06/468,779, filed on Feb. 22, 1983, now abandoned, by Richard Macor and entitled "COMPANION WRENCH", incorporated herein by reference in its entirety.

BACKGROUND OF THE INVENTION

1. Field of the Invention

The present invention relates to the field of tools, and more particularly to a multiple socket device as well as a wrench which includes the multiple socket device. A significant aspect of the present invention involves having four different conventional socket sizes located about a single axis.

2. Prior Art Statement

While the art of developing socket wrenches and related tools is well established, there is, nonetheless, a lack of significant improvement over the basic socket wrench design. Barbell type wrenches have been developed which have a multiplicity of wrench sizes at each end, but these are located about many different axis and require torquing at awkward wrench handle angles. Other types of multiple socket devices and wrenches known in the art are characterized by the following patents:

U.S. Pat. No. 2,571,570 to S. Hagar describes a telescoping wrench made of two tubes, one located within the other to achieve multiple sizes at each end, the choice of size being determined by selectively locating a holding pin so as to telescope out or in the ends of an inner tube with respect to the ends of an outer tube, each end of each such tube having a different size socket.

U.S. Pat. No. 2,814,227 to M. E. Cushman illustrates another type of telescoping wrench involving three tubes each having a different socket size, located within one another.

The inner two tubes are mounted so as to slide within the outer tube to selectively position the desired size. However, the two inner components are slit, shim type pieces which could slip and which require mechanical support from the outer tube to function. Also, Cushman does not teach the use of double ended, double sized inner members.

U.S. Pat. No. 3,187,610 to C. O. Russman describes a telescopic multiple socket wrench having four different sizes, two each on an inner and on an outer tube, the inner tube having a plurality of outside diameters and being mounted within the outer tube so as to extend (telescope) one end or the other beyond the end of the outer tube.

The present invention multiple socket device varies significantly from all three of the foregoing prior art devices as follows:

(1) The present invention multiple socket device has an inner tube which has no smooth or cylindrical surfaces, thereby allowing for much tighter, efficient fit of the inner tube within the outer tube;

(2) The present invention multiple socket device is the only device that can have four consecutive sizes of sockets in a single axis. While the published art teaches using four different sizes, they cannot be consecutive conventional sizes due to their clearance and strength requirements;

(3) The present invention multiple socket device has a total length which may be equal to or less than four times the height of a conventional bolt head or nut, permitting usage in tighter, closed areas. The prior art devices telescope, and, as shown in their drawings, are inherently relatively lengthy and cannot be used in tight corners or under small clearances;

(4) The present invention multiple socket device does not require holding pin holes, sliding button slits, or full length slits to create "shim" action or thick guides, one or more of which are required in all of the cited prior art;

(5) The present invention multiple socket device is designed such that full mechanically sound thicknesses may be used yet the outer member can accommodate a largest conventional socket size at its upper portion, a second largest size at its lower portion, and the inner member can accommodate a third largest conventional socket size at its upper portion and a fourth largest (smallest) size at its lower portion, all of these first, second, third and fourth largest sizes being sequential conventional sizes. This cannot be achieved with any of the prior art devices taught. For example, in Hagar and in Russman, the cylindrical outer walls of their inner tubes must have smaller diameters because they fit smooth cylindrical inner tubes into hexagonal outer tubes. For reasonably functional wall thicknesses, smaller inner tube inside diameters are needed, resulting in smaller socket sizes, i.e conventional sizes cannot be consecutive and some inbetween sizes are necessarily omitted.

Thus, for these reasons, the prior art illustrates the need for a more perfect and efficient multiple socket device. The prior art patents fail overwhelmingly in comparison to the present invention device and support the unobviousness of the present invention.

SUMMARY OF THE INVENTION

The present invention is a multiple socket device and a wrench employing same. The multiple socket device has four different socket sizes located about a single axis and has a first (outer) member and a second (inner) member. Both members are hollow and the second slidably fits into the first member. Each member has an upper portion and a lower portion, each such portion of each member having a different inside diameter corresponding to one of the four different socket sizes. A unique aspect of the invention is that the outer surface of the inner member, as well as the inner surface of both the inner member and the outer member, are entirely arrayed with angular longitudinal grooves. Another unique aspect of the present invention is its ability to accommodate four sequential socket sizes due to the fact that the outer diameter of the upper portion of the inner member is substantially identical to the inner diameter of the upper portion of the outer member, and the outer diameter of the lower portion of the inner member is substantially identical to the inner diameter of the lower portion of the outer member.

BRIEF DESCRIPTION OF THE DRAWINGS

Various other objects, features and attendant advantages of the present invention will be more fully appreciated as the same becomes better understood from the following detailed description in connection with the accompanying drawings, in which like reference characters designate like or corresponding parts through the several views and wherein.

DETAILED DESCRIPTION OF THE PRESENT INVENTION

Figure 1:
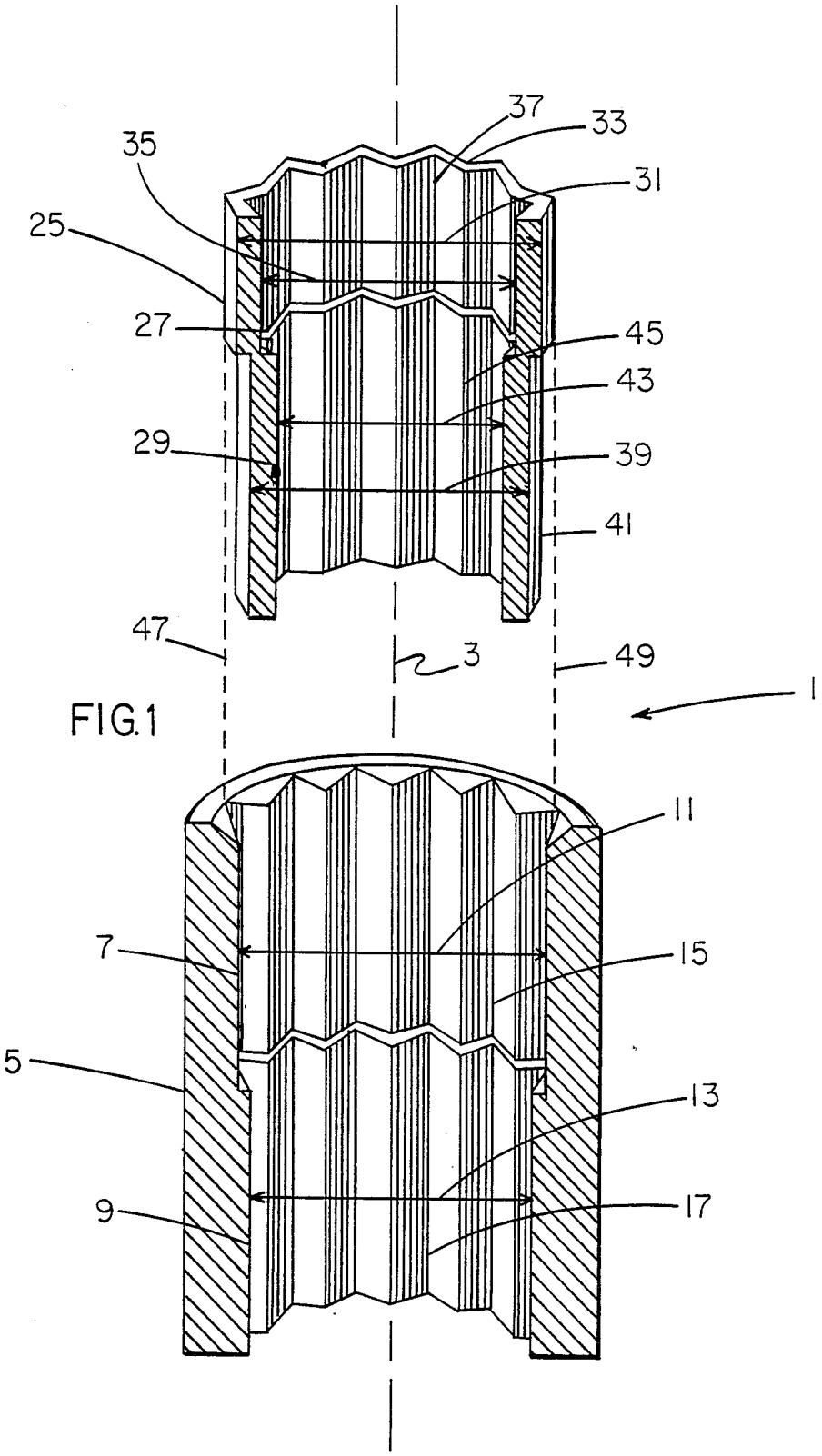
FIG. 1 illustrates a cut, blown apart, front view of a multiple socket device of the present invention.

Referring now more particularly to FIG. 1, a multiple socket device is shown generally as device 1. The multiple socket device 1 has four different conventional socket sizes located about single axis 3. In device 1, first member 5, is an outer member and has a generally hollow, cylindrical configuration about the single axis 3, as shown. First member 5 has an upper portion 7 and a lower portion 9. The upper portion 7 has a first inside diameter 11 corresponding to the largest of four different conventional socket sizes. Lower portion 9 has a second inside diameter 13 corresponding to the second largest of four different conventional socket sizes. Upper portion 7 and lower portion 9 both have an array of angular longitudinal grooves, exemplified by 15 and 17, spaced around their inside surfaces and extending for the entire length thereof.

Also, in device 1, a second member 25 is an inner member and has a generally hollow, cylindrical configuration, about the single axis 3. Second member 25 has an upper portion 27 and a lower portion 29. Upper portion 27 has an outside diameter 31 substantially equal to the inner diameter 11 of the upper portion 7 of first member 5. Upper portion 27 also has an array of angular longitudinal grooves 33 spaced around its outside surface corresponding to those grooves 15 on the inside surface of said upper portion 7 of first member 5. Upper portion 27 further has a (third) inside diameter 35 corresponding to the second smallest of four different conventional socket sizes. Also, upper portion 27 has an array of angular longitudinal grooves 37 spaced around its inside surface and extending for the entire length thereof. Lower portion 29 has an outisde diameter 39 substantially equal to the inner diameter 13 of the lower portion 9 of first member 5, and lower portion 29 also has an array of angular longitudinal grooves 41 spaced around its outside surface corresponding to those grooves 17 of the inside surface of lower portion 9 of first member 5. Also, lower portion 29 has a (fourth) inside diameter 43 corresponding to the smallest of four different conventional socket sizes and has an array of angular longitudinal grooves 45 spaced around its inner surface and extending for the entire length thereof. Second member 25 is designed to be slidably mounted within first member 5 along single axis 3 as shown by dotted lines 47 and 49.

Figure 2:
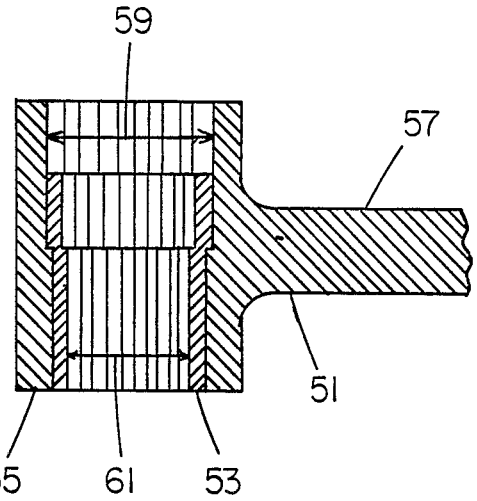
FIG. 2 illustrates a cut, front view of another multiple socket device of the present invention in which the inner member is in the downward position.

FIG. 2 shows another multiple socket device 51 having inner member 53 and outer member 55. This device 51 functions in the same manner as device 1 of FIG. 1 except that outer member 55 has a handle 57, shown in part. In FIG. 2, inner member 53 is in the downward position so as to render for use largest diameter socket 59 and smallest diamter socket 61.

Figure 3:
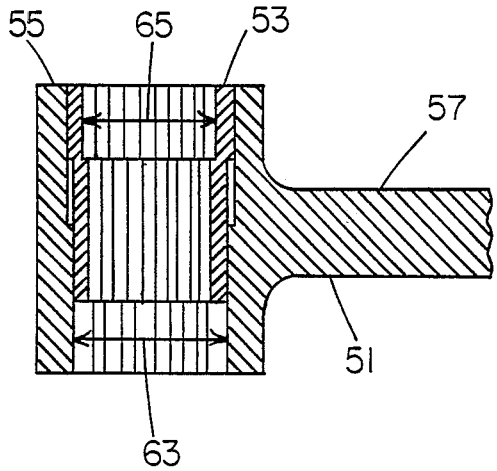
FIG. 3 illustrates a cut, front view of the multiple socket device of the present invention shown in FIG. 2 but with the inner member in the upward position.

FIG. 3 illustrates the same device 51 with inner member 53 and outer member 55 and handle 57. It should be noted that handle 57 may be a single device handle with, for example, ribs or a grip, or may be a part of a two device wrench such as is described in conunction with FIG. 5 below. In FIG. 3, inner member 53 is in the upward position so as to render for use second largest diameter socket 63 and third largest diameter socket 65.

As stated above, one unique feature of the present invention involves the ability to accommodate four consecutive or sequential conventional socket sizes. For example, device 51 shown in FIGS. 2 and 3 could be four consecutive standard American sizes, such as 5/16, $\frac{3}{8}$, 7/16, and $\frac{1}{2}$ inch or the like, or four consecutive metric sizes such as 12 mm, 13 mm, 14 mm and 15 mm. This cannot be achieved with the prior art devices cited above due to their need for clearances and functional thicknesses involving insertion of smooth cylindrical members into hexagonal or other "ratcheted" outer members.

Figure 4:
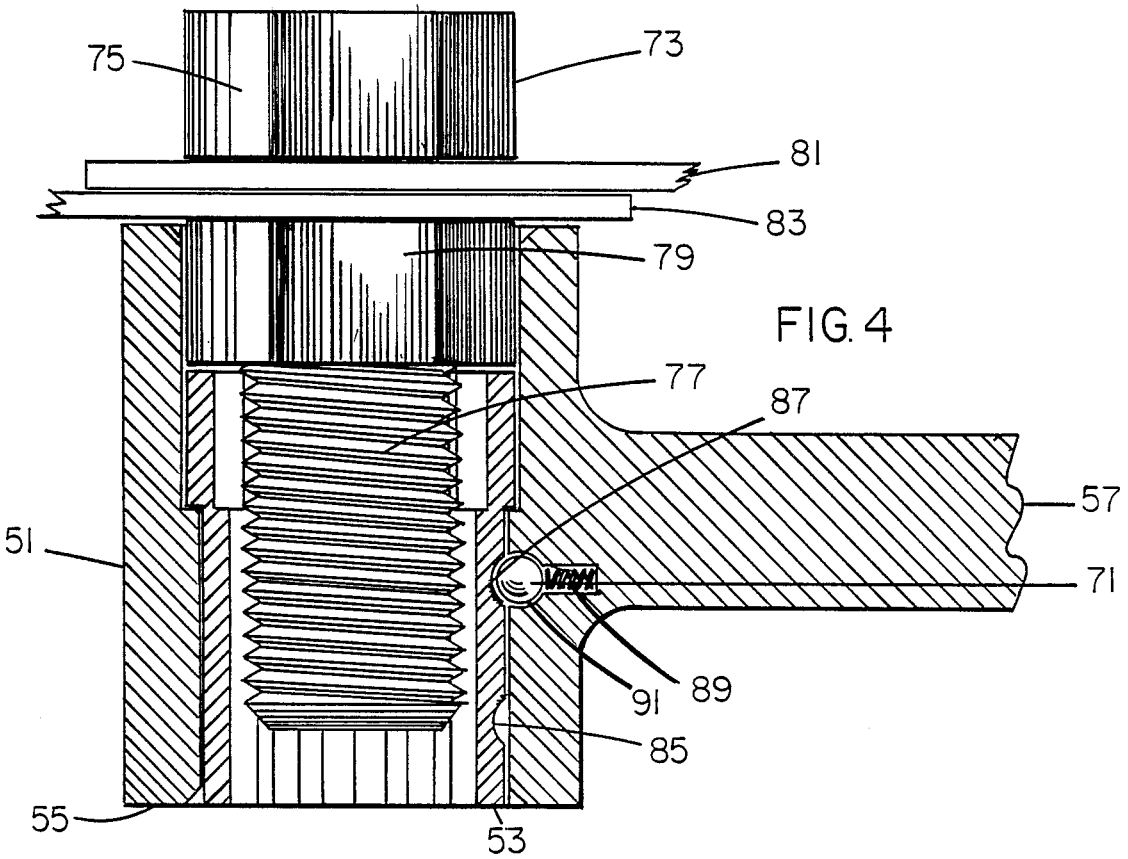
FIG. 4 is a cut, front view of a multiple socket device of the present invention showing details of a spring and ball means for releasably fixing the inner member, and showing the device in use on a nut and bolt.

Other unique features of the present invention device involve diameter internal clearance and height clearance. FIG. 4 illustrates these features, wherein device 51 of FIGS. 2 and 3 is shown, including inner member 53, outer member 55, but also illustrates the details of means 71 for releasably fixing inner member 53 at two possible different positions within outer member 55.

In FIG. 4, bolt 73, including bolt head 75 and threaded stem 77, along with nut 79, are shown bolting together plates 81 and 83. Nut 79 has a diameter size equal to socket diameter 59 (FIG. 3) and device 51 fits over nut 79 snuggly to tighten or loosen nut 79 onto stem 77. As is vividly illustrated in FIG. 4, stem 77, of conventional size, can easily clear the smallest inner diameter of the device (diameter 61 of FIG. 2), a function that cannot be accomplished with the prior art devices.

Also, as mentioned, FIG. 4 illustrates the details of means 71 for releasably fixing inner member 53. Here, two different positions are available for releasably fixing inner member 53, one at groove 85 and the other at groove 87 located along the side of inner member 53. Spring 89 and ball 91 engage groove 87 as shown to fix inner member 53. Tension on spring 89 is designed such that tapping the device at the end to which one desires inner member 53 to move will cause the mass of inner member 53 to slide so as to engage the available groove with spring 89 and ball 91.

Also, as mentioned, vertical clearance of device 51 itself is achieved to optimum capability due to the fact that either the upper portion or the lower portion of the inner member of any present invention device may optionally but advantageously be no more than half the length of its outer member counterpart portion. This enables the inner member to move slidably between two positions without ever extending or telescoping beyond the outer member and always maintaining the total length of the outer member.

Figure 5:
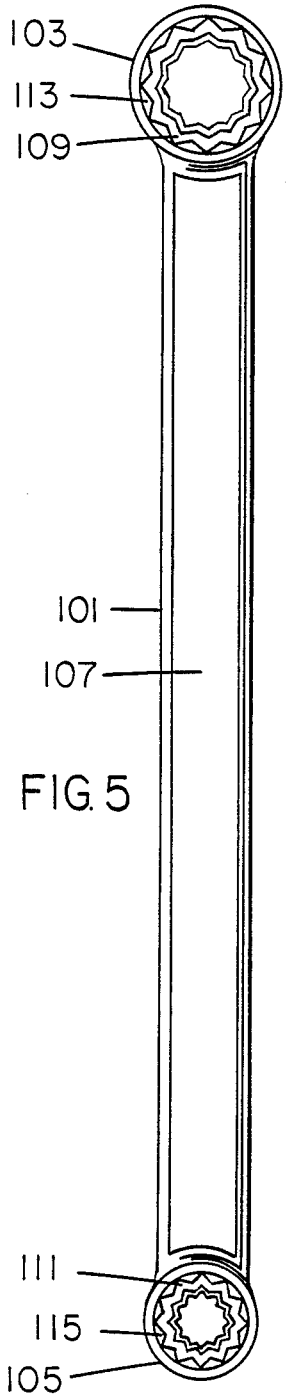
FIG. 5 illustrates a present invention wrench having a handle and two multiple sockets, one at each end.
Figure 6:
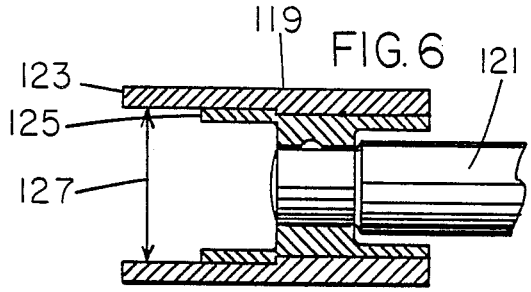
FIGS. 6, 7, 8 and 9 show a present invention device of the type shown in FIG. 1 but having a receiving slot for use in conjunction with a lug wrench or ratchet wrench, each of the Figures showing four different wrench piece locations for use of the four different socket sizes.
Figure 7:
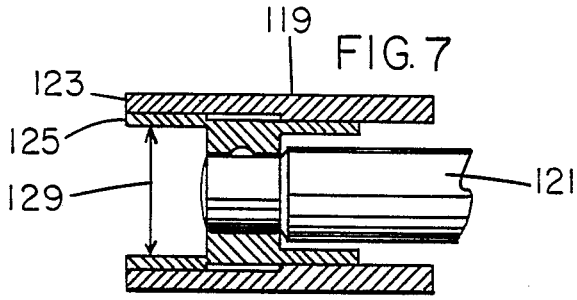
Figure 8:
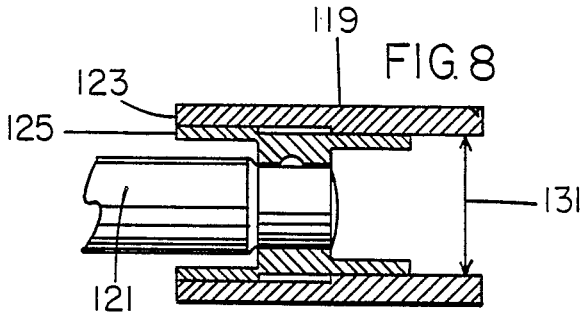
Figure 9:
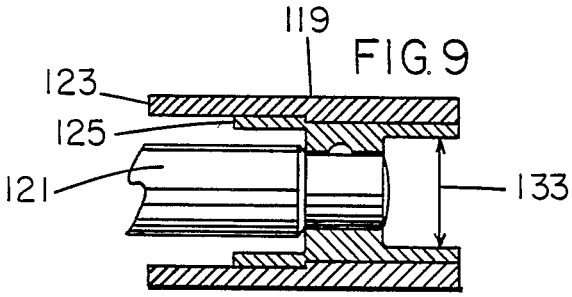

FIG. 5 illustrates an eight-socket wrench 101 comprising two multiple socket devices 103 and 105, respectively, connected to one another via handle 107. Each of the multiple socket devices 103 and 105 have four different conventional socket sizes about a single axis (not shown) and each of the multiple socket devices 103 and 105 have inner members 109 and 111 and outer members 113 and 115, similar to the device 51 shown in FIGS. 2, 3 and 4. Thus, wrench 101 may be designed to accommodate sizes 5/16, $\frac{3}{8}$, 7/16 and $\frac{1}{2}$ inch at device 105 and sizes 9/16, $\frac{5}{8}$, 11/16, and $\frac{3}{4}$ inch at device 103, i.e. eight consecutive conventional sizes.

FIGS. 6, 7, 8 and 9 show the device 119 similar to that described in conjunction with FIG. 1, but adapted to receive a lug wrench end 121. Device 119 has outer member 123 and inner member 125, as shown in all four figures. Wrench end 121 is shown as the end of a lug wrench but could be the end of a ratchet wrench extension. In FIGS. 6, 7, 8 and 9, device 119, is, as shown, positioned along with wrench end 121 to produce largest socket diameter 127, third largest socket diameter 129, second largest socket diameter 131 and smallest socket diameter 133 ready for use.

Obviously, numerous modifications and variations of the present invention are possible in light of the above teachings. It is therefore to be understood that within the scope of the appended claims, the invention may be practiced otherwise than as specifically described herein.

What is claimed is:

1. A multiple socket device having four different conventional socket sizes about a single axis, comprising:

(a) a first member being an outer member and having a generally hollow, cylindrical configuration about said single axis, said first member having an upper portion and a lower portion, the upper portion having a first inside diameter corresponding to the largest of said four different conventional socket sizes, and the lower portion having a second inside diameter corresponding to the second largest of said four different conventional socket sizes, each of said upper portion and said lower portion having an array of angular longitudinal grooves spaced around its inside surface and extending for the entire length thereof;

(b) a second member being an inner member and having a generally hollow, cylindrical configuration, about said single axis, said second member having an upper portion and a lower portion, the upper portion having an outside diameter substantially equal to the inner diameter of the upper portion of said first member and having an array of angular longitudinal grooves spaced around its outside surface corresponding to those on the inside surface of said upper portion of said first member, said upper portion further having a third inside diameter corresponding to the second smallest of said four different conventional socket sizes and having an array of angular longitudinal grooves spaced around its inside surface and extending for the entire length thereof, the lower portion having an outside diameter substantially equal to the inner diameter of the lower portion of said first member and having an array of angular longitudinal grooves spaced around its outside surface corresponding to those of the inside surface of said lower portion of said first member, said lower portion further having a fourth inside diameter corresponding to the smallest of said four different conventional socket sizes and having an array of angular longitudinal grooves spaced around its inner surface and extending for the entire length thereof, said second member being slidably mounted within said first member along said single axis and being releasably fixed so as to move axially within said first member between two fixed positions without protruding from said first member.

2. The device of claim 1 further comprising means for releasably fixing said second member at two different positions within said first member.

3. The device of claim 1 wherein said four different conventional socket sizes are four consecutive sizes.

4. The device of claim 3 wherein said different conventional socket sizes are consecutive sizes selected from the group consisting of metric sizes.

5. The device of claim 3 wherein said different conventional socket sizes are consecutive sizes selected from the group consisting of standard American sizes.

6. The device of claim 2 wherein said means comprises a spring-loaded mass protruding from an inside surface of said first member and two indentations on the outer surfaces of said second member.

7. A multiple socket device having four different conventional socket sizes about a single axis, comprising:

(a) a first member being an outer member and having a generally hollow, cylindrical configuration about said single axis, said first member having an upper portion and a lower portion, the upper portion having a first inside diameter corresponding to the largest of said four different conventional socket sizes, and the lower portion having a second inside diameter corresponding to the second largest of said four different conventional socket sizes, each of said upper portion and said lower portion having an array of angular longitudinal grooves spaced around its inside surface and extending for the entire length thereof;

(b) a second member being an inner member and having a generally hollow, cylindrical configuration, about said single axis, said second member having an upper portion and a lower portion, the upper portion having an outside diameter substantially equal to the inner diameter of the upper portion of said first member and having an array of angular longitudinal grooves spaced around its outside surface corresponding to those on the inside surface of said upper portion of said first member, said upper portion further having a third inside diameter corresponding to the second smallest of said four different conventional socket sizes and having an array of angular longitudinal grooves spaced around its inside surface and extending for the entire length thereof, the lower portion having an outside diameter substantially equal to the inner diameter of the lower portion of said first member and having an array of angular longitudinal grooves spaced around its outside surface corresponding to those of the inside surface of said lower portion of said first member, said lower portion further having a fourth inside diameter corresponding to the smallest of said four different conventional socket sizes and having an array of angular longitudinal grooves spaced around its inner surface and extending for the entire length thereof, said second member being slidably mounted within said first member along said single axis and wherein said upper portion of said second member is no more than half the length of said upper portion of said first member.

8. The device of claim 7 further comprising means for releasably fixing said second member at two different positions within said first member.

9. The device of claim 7 wherein said four different conventional socket sizes are four consecutive sizes.

10. The device of claim 9 wherein said different conventional socket sizes are consecutive sizes selected from the group consisting of metric sizes.

11. The device of claim 9 wherein said different conventional socket sizes are consecutive sizes selected from the group consisting of standard American sizes.

12. The device of claim 8 wherein said means comprises a spring-loaded mass protruding from an inside surface of said first member and two indentations on the outer surfaces of said second member.

13. The device of claim 7 wherein said lower portion of said second member is substantially equal in length to said lower portion of said first member.

14. An eight-socket wrench comprising two multiple socket devices connected to one another, each of said multiple socket devices having four different conventional socket sizes about a single axis, each of said multiple socket devices comprising:

(a) a first member being an outer member and having a generally hollow, cylindrical configuration about said single axis, said first member having an upper portion and a lower portion, the upper portion having a first inside diameter corresponding to the largest of said four different conventional socket sizes, and the lower portion having a second inside diameter corresponding to the second largest of said four different conventional socket sizes, each of said upper portion and said lower portion having an array of angular longitudinal grooves around its inside surface and extending for the entire length thereof;

(b) a second member being an inner member and having a generally hollow, cylindrical configuration, about said single axis, said second member having an upper portion and a lower portion, the upper portion having an outside diameter substantially equal to the inner diameter of the upper portion of said first member and having an array of angular longitudinal grooves spaced around its outside surface corresponding to those on the inside surface of said upper portion of said first member, said upper portion further having a third inside diameter corresponding to the second smallest of said four different conventional socket sizes and having an array of angular longitudinal grooves spaced around its inside surface and extending for the entire length thereof, the lower portion having an outside diameter substantially equal to the inner diameter of the lower portion of said first member and having an array of angular longitudinal grooves spaced around its outside surface corresponding to those of the inside surface of said lower portion of said first member, said lower portion further having a fourth inside diameter corresponding to the smallest of said four different conventional socket sizes and having an array of angular longitudinal grooves spaced around its inner surface and extending for the entire length thereof, said second member being slidabley mounted within said first member along said single axis and wherein said second member is releasably fixed so as to move axially within said first member between two fixed positions without protruding from said first member.

15. The wrench of claim 14 further indicating an elongated handle wherein said two multiple socket devices are located at opposite ends thereof.

16. The wrench of claim 14 further comprising means for releasably fixing said second member at two different positions within said first member of each of said two multiple socket devices.

17. The wrench of claim 14 wherein each of said four different conventional socket sizes are four consecutive sizes.

18. The wrench of claim 17 wherein said different conventional socket sizes are consecutive sizes selected from the group consisting of metric sizes.

19. The wrench of claim 17 wherein said different conventional socket sizes are consecutive sizes selected from the group consisting of standard American sizes.

20. The wrench of claim 16 wherein said means comprises a spring-loaded mass protruding from an inside surface of said first member and two indentations on the outer surfaces of said second member.

21. The wrench of claim 14 wherein said second member is slidably mounted within said first member along said single axis so as to move between two fixed positions and from one to the other by being manually tapped.

22. An eight-socket wrench comprising two multiple socket devices connected to one another, each of said multiple socket devices having four different conventional socket sizes about a single axis, each of said multiple socket devices comprising:

(a) a first member being an outer member and having a generally hollow, cylindrical configuration about said single axis, said first member having an upper portion and a lower portion, the upper portion having a first inside diameter corresponding to the largest of said four different conventional socket sizes, and the lower portion having a second inside diameter corresponding to the second largest of said four differenet conventional socket sizes, each of said upper portion and said lower portion having an array of angular longitudinal grooves around its inside surface and extending for the entire length thereof;

(b) a second member being an inner member and having a generally hollow, cylindrical configuration, about said single axis, said second member having an upper portion and a lower portion the upper portion having an outside diameter substantially equal to the inner diameter of the upper portion of said first member and having an array of angular longitudinal grooves spaced around its outside surface corresponding to those on the inside surface of said upper portion of said first member, said upper portion further having a third inside diameter corresponding to the second smallest of said four different conventional socket sizes and having an array of angular longitudinal grooves spaced around its inside surface and extending for the entire length thereof, the lower portion having an outside diameter substantially equal to the inner diameter of the lower portion of said first member and having an array of angular longitudinal grooves spaced around its outside surface corresponding to those of the inside surface of said lower portion of said first member, said lower portion further having a fourth inside diameter corresponding to the smallest of said four different conventional socket sizes and having an array of angular longitudinal grooves spaced around its inner surface and extending for the entire length thereof, said second member being slidably mounted within said first member along said single axis and wherein said upper portion of said second member is no more than half the length of said upper portion of said first member of each of said two multiple socket devices.

23. The wrench of claim 22 further indicating an elongated handle wherein said two multiple socket devices are located at opposite ends thereof.

24. The wrench of claim 22 further comprising means for releasably fixing said second member at two different positions within said first member of each of said two multiple socket devices.

25. The wrench of claim 22 wherein for each of said two multiple socket devices, said four different conventional socket sizes are four consecutive sizes.

26. The wrench of claim 25 wherein said different conventional socket sizes are consecutive sizes selected from the group consisting of metric sizes.

27. The wrench of claim 25 wherein said different conventional socket sizes are consecutive sizes selected from the group consisting of standard American sizes.

28. The wrench of claim 24 wherein said means comprises a spring-loaded mass protruding from an inside surface of said first member and two indentations on the outer surfaces of said second member.

29. The wrench of claim 22 wherein said second member is slidably mounted within said first member along said single axis so as to move between two fixed positions and from one to the other by being manually tapped.

30. The device of claim 22 wherein said lower portion of said second member is substantially equal in length to said lower portion of said first member of each of said two multiple socket devices.

* * * * *